United States Patent [19]

Notelteirs

[11] 3,991,337

[45] Nov. 9, 1976

[54] ELECTRIC LAMP

[75] Inventor: Victor Rosallie Notelteirs, Eindhoven, Netherlands

[73] Assignee: U.S. Philips Corporation, New York, N.Y.

[22] Filed: May 5, 1975

[21] Appl. No.: 574,613

[30] Foreign Application Priority Data

May 17, 1974 Netherlands ..... 7406637

[52] U.S. Cl. ..... 313/217; 313/332

[51] Int. Cl.[2] ..... H01J 61/06

[58] Field of Search ..... 313/331, 332, 217; 174/50.64

[56] References Cited

UNITED STATES PATENTS 3,211,826 10/1965 Holcomb et al. ..... 174/50.64

*Primary Examiner*—R. V. Rolinec
*Assistant Examiner*—Darwin R. Hostetter
*Attorney, Agent, or Firm*—Frank R. Trifari

[57] ABSTRACT

Outer molybdenum current conductors of electric lamps having quartz glass lamp envelopes and pinched seals have a corrosion-resistant metal coating. The current conductors have been ground bare at the end which is welded to a molybdenum foil incorporated in the pinched seal.

As a result of this it is achieved that the current conductors do not corrode, that the welding electrode upon making the connection to the foil does not stick to the coating, and that upon making the pinched seal the electric contact between the foil and the current conductor is not interrupted.

3 Claims, 6 Drawing Figures

ELECTRIC LAMP

The invention relates to an electric lamp having a quartz glass lamp envelope with pinched seal, a molybdenum foil, to which an inner current conductor and an outer current conductor of molybdenum are welded, being incorporated in the pinched seal.

Molybdenum is an oxidation-sensitive material. Consequently, outer current conductors of said material will soon be oxidized so that they no longer make a good electric contact with the connection terminals of a current source.

Nevertheless one is obliged to use molybdenum for the outer current conductors, since said material has a coefficient of expansion which corresponds best to that of quartz glass and the outer current conductor should be locked deeply in the pinch so as to be able to overcome the forces occurring when the lamp is connected to the current source.

The molybdenum current conductors might be provided with a coating of an oxidation-resistant metal, for example, nickel or palladium, platinum, gold or indium on a primer layer of nickel or copper. However, said coatings form alloys with molybdenum which melt at approximately 1500° C. When making the pinched seal of the lamp envelope, however, the temperature is approximately 1800° C. When using coated molybdenum current conductors, the electric contact between said current conductors and the molybdenum foil is interrupted upon making the pinched seal. This is caused by alloying and fusing of the metal of the coating and the molybdenum of the foil and the current conductor.

Another drawback of the use of coated molybdenum current conductors is that the production has to be interrupted frequently because the welding electrodes after making the connection between the current conductor and the molybdenum foil stick to the coating.

Since it cannot readily be done in practice to give the outer current conductors a coating only over a part so that the place where the connection to the foil is to be effected remains uncovered, lamps have been made having an outer current conductor which consists of two parts: a part of molybdenum connected to the molybdenum foil and extending to the end of the pinch and a part of corrosion-resistant material connected to the first part by means of resistance butt welding.

This construction suffers from the drawback of requiring an extra welding operation and moreover having a low mechanical strength.

It is the object of the invention to provide a simple and efficacious solution to the described problem.

According to the invention, electric lamps of the kind mentioned in the preamble are characterized in that the outer current conductor has a corrosion-resistant metal coating and has been ground bare at the end welded to the foil.

It has been found that it is not necessary for the coating to have been removed from the current conductor on all sides at the said end. For a good electric contact between the molybdenum foil and the current conductor after welding it is already sufficient for the current conductor to be ground bare at the welding surface. In order to prevent sticking of the welding electrode it is sufficient for the coating to have been removed from the current conductor on the side present diametrically opposite to the welding surface.

A preferred embodiment of the electric lamp according to the invention is therefore characterized in that the outer current conductor has been ground bare at the welding surface and on the side present diametrically opposite thereto.

In this preferred embodiment the molybdenum welding surface of the current conductor is bounded by a zone of the coating material. It has surprisingly been found that the material of said zone has no detrimental effect on the quality of the connection between the molybdenum foil and the conductor.

The current conductor is preferably ground in such manner that a flat welding surface and a flat contact surface for the welding electrode is obtained.

In contrast with the above-mentioned theoretical solution according to which the outer current conductor would have to be provided only partially with a coating, the solution to the described problem according to the invention can be performed in practice and is suitable for mechanisation.

The conventional materials may be used for the corrosion-resistant coating, for example, nickel or platinum, palladium, gold, iridium on a primer layer of nickel or copper.

The invention may be applied both to incandescent lamps, for example, incandescent lamps for projection purposes which are assembled in a cold light mirror with a cement which in itself is corrosive for molybdenum, and to discharge lamps.

The invention will be described in greater detail with reference to the drawing.

Figure 1:
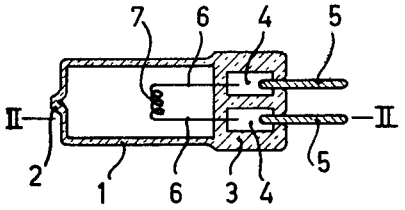
FIG. 1 is an elevation of an electric incandescent lamp.

In FIG. 1, the quartz glass lamp envelope 1 is closed at one end by an exhaust tube seal 2 and at the other end by the pinched seal 3. Incorporated in the pinched seal are molybdenum foils 4 to which are welded both outer current conductors 5 of molybdenum coated with a corrosion-resistant metal and inner current conductors 6 which extend towards the filament 7.

Figure 2:
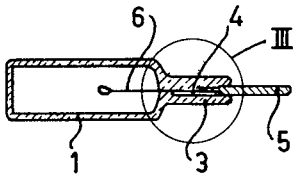
FIG. 2 is a longitudinal sectional view taken on the line II — II of FIG. 1.
Figure 3:
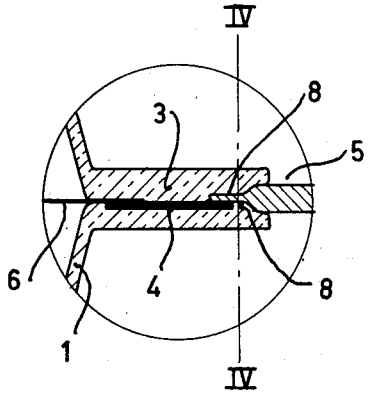
FIG. 3 shows a detail on an enlarged scale of the pinched seal.
Figure 4:
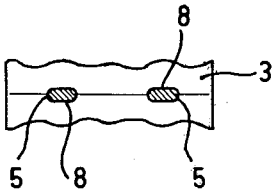
FIG. 4 is cross-sectional view taken on the line IV — IV of FIG. 3.

The reference numerals in FIGS. 2, 3 and 4 designate the same components as in FIG. 1. Reference numeral 8 in FIGS. 3 and 4 designates the surfaces of the external conductor which have been ground bare.

Figure 5:
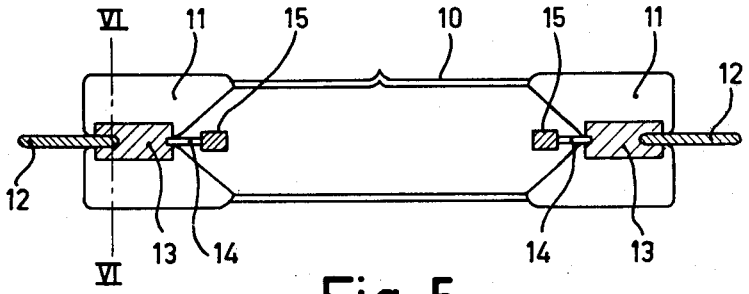
FIG. 5 is an elevation of a discharge lamp.

Reference numeral 10 in FIG. 5 denotes a quartz glass lamp envelope with pinched seals 11 in which molybdenum foils 13 are incorporated to which are welded outer current conductors 12 of coated molybdenum as well as inner current conductors 14 on which the electrodes 15 are mounted.

Figure 6:
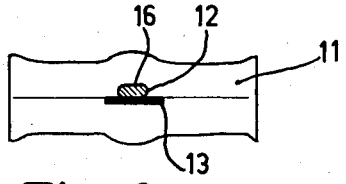
FIG. 6 is a cross-sectional view taken on the line VI — VI of FIG. 5.

The reference numerals in FIG. 6 have the same meanings as in FIG. 5. Reference numeral 16 denotes the contact surface of the outer current conductor for the welding electrode which has been ground bare.

What is claimed is:

1. An electric lamp having a quartz glass lamp envelope with pinched seal, a molybdenum foil, to which an inner current conductor and an outer current conductor of molybdenum are welded, being incorporated in the pinched seal, characterized in that the outer current conductor has a corrosion-resistant metal coating and has been ground bare at the end welded to the foil.

2. An electric lamp as claimed in claim 1, characterized in that the outer current conductor has been ground bare at the welding surface and on the side present diametrically opposite thereto.

3. An electric lamp as claimed in claim 2, characterized in that both ground surfaces are flat.

* * * * *